US009132433B2

(12) United States Patent
Cooke et al.

(10) Patent No.: US 9,132,433 B2
(45) Date of Patent: Sep. 15, 2015

(54) ADJUSTABLE DIVERTER OR FLOW CONTROLLER FOR A FLOW APPARATUS

(75) Inventors: Graeme Cooke, Bonogin (AU); Mark Palmer, Ashmore (AU)

(73) Assignee: Mineral Technologies Pty Ltd, South Brisbane (AU)

( * ) Notice: Subject to any disclaimer, the term of this patent is extended or adjusted under 35 U.S.C. 154(b) by 204 days.

(21) Appl. No.: 13/642,678

(22) PCT Filed: Apr. 28, 2011

(86) PCT No.: PCT/AU2011/000490

§ 371 (c)(1), (2), (4) Date: Dec. 13, 2012

(87) PCT Pub. No.: WO2011/134015

PCT Pub. Date: Nov. 3, 2011

(65) Prior Publication Data

US 2013/0092272 A1 Apr. 18, 2013

(30) Foreign Application Priority Data

Apr. 29, 2010 (AU) ..... 2010901818

(51) Int. Cl.
*B03B 11/00* (2006.01)
*B03B 5/62* (2006.01)

(52) U.S. Cl.
CPC ..... *B03B 11/00* (2013.01); *B03B 5/626* (2013.01); *Y10T 137/877* (2015.04)

(58) Field of Classification Search
CPC ..... B03B 5/52; B03B 5/62; B03B 5/626; B07B 13/11; B01D 21/302; F16K 41/10; F16K 41/103
USPC ..... 209/362, 434, 459, 488, 489, 491, 493, 209/497, 500, 697, 651–653; 251/318, 319, 251/331; 137/861–863, 872, 884
See application file for complete search history.

(56) References Cited

U.S. PATENT DOCUMENTS

| | | | | | |
|---|---|---|---|---|---|
| 798,622 | A | * | 9/1905 | Pollock | 209/697 |
| 1,516,926 | A | * | 11/1924 | Pardee | 209/697 |
| 1,914,282 | A | * | 6/1933 | O'Toole, Sr. | 209/723 |
| 1,959,736 | A | * | 5/1934 | Rademacher | 209/697 |
| 2,615,572 | A | * | 10/1952 | Hodge | 209/454 |
| 3,672,503 | A | * | 6/1972 | Mark | 209/722 |

(Continued)

FOREIGN PATENT DOCUMENTS

| | | |
|---|---|---|
| AU | 27077/84 | 11/1984 |
| WO | 02/092232 | 11/2002 |
| WO | 2010/012038 | 2/2010 |

*Primary Examiner* — Joseph C Rodriguez
(74) *Attorney, Agent, or Firm* — Whitham, Curtis, Christofferson & Cook, P.C.

(57) ABSTRACT

The present invention provides a diverter or flow controller 1.060, 26.060 for controlling a flow on or within an apparatus 1.001, 26.500, including at least one diverter or flow controller element 1.065, 26.2 and one or more displacement members 1.064, 26.064 adapted to move at least part of the diverter or flow controller element 1.065, 26.2 or a corresponding one of the diverter or flow controller element 1.065, 26.2 into or out of contact with a flow path. The invention also provides a remotely controlled diverter or flow controller and is applicable to flow devices or apparatus such as spiral concentrators and banks of these as up-current classifiers, hydraulic classifiers, teeter bed style classifiers, sluices, weirs, or channels.

8 Claims, 11 Drawing Sheets

(56) References Cited

U.S. PATENT DOCUMENTS

| | | | | |
|---|---|---|---|---|
| 4,146,137 | A * | 3/1979 | Beckham | 209/696 |
| 4,189,378 | A * | 2/1980 | Wright et al. | 209/459 |
| 4,198,004 | A * | 4/1980 | Albus et al. | 241/39 |
| 4,505,811 | A | 3/1985 | Griffiths et al. | |
| 4,597,861 | A | 7/1986 | Wright | |
| 4,614,580 | A | 9/1986 | Giffard | |
| 4,836,926 | A * | 6/1989 | Grobler | 210/512.1 |
| 5,452,805 | A * | 9/1995 | Robertson et al. | 209/697 |
| 5,598,914 | A * | 2/1997 | Sulzer et al. | 193/12 |
| 6,264,041 | B1 | 7/2001 | Niitti | |
| 8,813,967 | B2 * | 8/2014 | Plant et al. | 209/139.1 |
| 8,931,644 | B2 * | 1/2015 | Lean et al. | 209/726 |
| 2004/0211711 | A1 | 10/2004 | Palmer | |
| 2009/0283452 | A1 * | 11/2009 | Lean et al. | 209/155 |
| 2013/0341255 | A1 * | 12/2013 | DeJong et al. | 209/606 |
| 2014/0238906 | A1 * | 8/2014 | Mohanty et al. | 209/571 |

* cited by examiner

ADJUSTABLE DIVERTER OR FLOW CONTROLLER FOR A FLOW APPARATUS

FIELD OF THE INVENTION

This invention relates to a diverter or flow controller for flow apparatus for mineral processing such as a spiral concentrator, an up-current classifier, an hydraulic classifier, a teeter bed style classifier, a sluice, a weir, or a channel.

BACKGROUND OF THE INVENTION

Our co-pending application PCT/AU2009/000975, which is incorporated herein by reference, describes an adjustable spiral concentrator with an adjustable diverter in the form of an inflatable bladder.

Spiral concentrators are used to separate minerals by providing a descending spiral trough down which a mineral slurry flows. The slurry flow is subjected to centrifugal and gravitational forces. The heavier minerals (high density particles) accumulate towards the inner part of the trough and the gangue (low density particles) tend towards the outer part of the trough.

Various modifications to the trough have been proposed to improve separation performance. An example of a spiral concentrator with a flow diverter can be found in WO02092232.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a diverter or flow controller for controlling a flow on or within an apparatus, including at least one diverter or flow controller element and one or more displacement members adapted to move at least part of the diverter or flow controller element or a corresponding one of the baffles into or out of contact with a flow path.

The diverter or flow controller element can include at least one diverter baffle.

The baffle can be a single element.

The baffle can be flexible.

The diverter or flow controller element can include two or more displacement baffles.

The or each displacement member can be pressure actuated.

The or each displacement member can be attached to a diverter or flow controller arm.

The diverter or flow controller element can be a dart splitter.

The diverter or flow controller arm can be adjustable in length and or position.

There can be included attachment means to attach the diverter or flow controller to the apparatus or a trough of the apparatus.

The diverter or flow controller can include mounting means to connect to a mounting bracket, the mounting bracket adapted to be mounted to the apparatus.

The mounting means includes shaped channel and mating projection to allow the bracket and diverter to be slidingly engaged.

The diverter or flow controller can include a housing to cover the one or more displacement members.

The displacement member can shaped and/or composed of a material whereby application of force causes the displacement member to extend and discontinuing the force, will result in the shape or a characteristic of the material, retracting the displacement member.

The displacement member can have a shape which includes a bellow or bellows formation.

The bellow or bellows formation can be formed by a portion of a wall being formed at moulding with a wall portion which folds back over itself through approximately 180 degrees.

The elasticity of a bend of the bellow or bellows can provide a retraction bias.

The characteristic of the material can be one or more of the following: elasticity; shape memory; material memory; rigidity.

The displacement member or members can be moved between an extended and a retracted condition by one or more of the following: air pressure for both retraction and extension; electrically operated solenoid for both retraction and extension; linear actuator for both retraction and extension; air operated piston and cylinder for both retraction and extension; air pressure to extend and a biasing formation to retract; air pressure to extend and a spring to retract; biasing formation or spring to extend and air pressure to retract.

The displacement members can inter-connect with a foot member.

A flexible shroud can fit around the foot and attach to the housing.

The shroud and foot can be integrally formed, or the displacement member, the shroud and the foot can be integrally formed.

The foot member can include one or more of the following: a single integrated foot of elastic material; a composite of rigid or flexible material positionable under the displacement members and an elastic joint between them; a number of rigid or flexible members with a sliding join between them; a number of rigid or flexible members with a sliding interlocked join between them.

At one or more ends of the diverter or flow controller and an associated mounting bracket or brackets cooperating respectively therewith, there can be included height adjustment means to allow the end or ends of the diverter to be height adjustable relative to mounting brackets and the apparatus.

The height adjustment means can be a threaded aperture in the diverter which is engaged by a threaded pin associated with the mounting bracket or brackets.

The associated mounting brackets also include one or more of the following: a ball and socket joint; a captured threaded pin; a reversible formation to engage a rim of a spiral concentrator such that one side will engage a clockwise spiral concentrator and another side which will engage a counter clockwise spiral concentrator; a reversible formation to engage a central column of a spiral concentrator such that one side will engage a central column of a clockwise spiral concentrator and another side which will engage a central column of a counter clockwise spiral concentrator.

The displacement members can be moved from an extended to a retracted condition and or a retracted condition to an extended condition by one or more than one of the following: compressed air; the shape or material of a bladder; a spring; a linear actuator; a piston and cylinder; a solenoid actuator; hydraulic means; pneumatic means; control means from a remote location; control means located at the diverter or flow controller.

The apparatus can be one of the following: a spiral concentrator, an up-current classifier, hydraulic classifier, teeter bed style classifier, a sluice, a weir, or a channel.

The diverter or flow controller can be fully immersed and is used to control the discharge flow of the apparatus.

The flow being controlled can be one of: a slurry; a slurry and wash water combination; wash water; a particulate in a slurry.

At least one diverter or flow control element and the one or more displacement members can be arranged on a support so as to surround one or more draining apertures from an apparatus.

The apparatus can be an up current classifier and the diverter or flow controller can be mounted for submersion therein around drainage apertures therefrom, and whereby the displacement members extend to close and retract to open so that slurry in the base of said classifier can pass out of the classifier via said drainage apertures.

The present invention also provides a ball and socket arrangement for mounting a diverter or flow controller component to an apparatus, wherein one of the ball and socket includes position adjustment means thereon.

The portion with the ball can include a threaded shaft.

The threaded shaft can include a handle means so as to rotate the shift with respect to the socket.

The socket can be made from an assembly of at least two parts.

A screw means which holds the assembly of at least two parts together also functions to releasably hold or immobilise the ball in the socket.

The device to be mounted can includes a threaded aperture to receive the shaft of the ball.

The present invention also provides a diverter or flow controller, or ball and socket arrangement, as described above, wherein the apparatus is one of the following: a spiral concentrator, a sluice, a weir, or a channel.

The present invention also provides a diverter or flow controller, or ball and socket arrangement, as described above, wherein the flow being controlled is one of: a slurry; a slurry and wash water combination; wash water.

The present invention also provides a diverter or flow controller, as described above, wherein the flow being controlled is fully immersed such as at the bottom of a tank or sump or to control the discharge of underflow of an up-current classifier The present invention further provides a spiral concentrator, an up-current classifier, an hydraulic classifier, a teeter bed style classifier, a sluice, a weir, or a channel having a diverter or flow controller as described above, or a ball and socket arrangement for mounting a diverter or flow controller as described above.

The above described diverter or flow controller and the apparatus into or onto which it is installed can be remotely operated by a programmable controller so that banks of diverters or flow controllers, and individual elements of individual diverters or flow controllers can be made to function simultaneously or sequentially or in a pre programmed pattern.

The present invention also provides a mineral ore processing apparatus having a plurality of diverter or flow controllers as described above, the diverters or flow controllers being remotely controlled such that individual displacement elements of respective ones of the diverter or flow controller are made to function simultaneously or sequentially in parallel or in sequence or in a pre-programmed pattern.

A plurality of mineral ore processing apparatuses as described above, can be arranged into banks or clusters, the banks or clusters being remotely controlled so that individual displacement elements of respective ones of the diverter or flow controllers are made to function in respective apparatus simultaneously or sequentially, in parallel or in sequence, or in a pre-programmed pattern.

BRIEF DESCRIPTION OF THE DRAWINGS

An embodiment or embodiments of the present invention will now be described, by way of example only, with reference to the accompanying drawings, in which.

Figure 1:
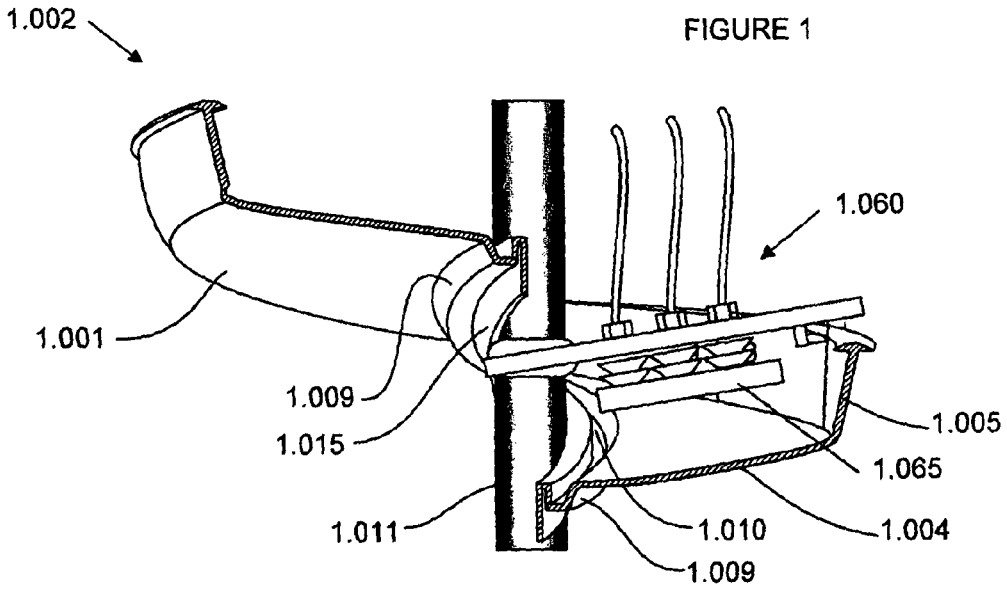
FIG. 1 is a schematic partial view of an embodiment of a spiral concentrator including a diverter according to an embodiment of the invention.

The numbering convention used in the drawings is that the digits in front of the full stop indicate the drawing number, and the digits after the full stop are the element reference numbers. Where possible, the same element reference number is used in different drawings to indicate corresponding elements.

The drawings are intended to illustrate the inventive features of the embodiments illustrated and are not necessarily to scale.

DETAILED DESCRIPTION OF THE EMBODIMENT OR EMBODIMENTS

The following description and the figures illustrate the invention with respect to spiral concentrators and banks of these, which in the main are used to separate slurries into component parts. However the present invention can be utilised with other flow apparatus, such as up-current classifiers, hydraulic classifiers, teeter bed style classifiers, sluices, weirs, or channels. Further, the substance flowing in these apparatus is not limited to slurries but can include a slurry and wash water combinations; or wash water or other flowable or fluid substances.

FIG. 1 shows a segment of a spiral concentrator having a trough 1.001 with a profile illustrated at 1.004. The trough has an outer wall 1.005 defining an outer rim a concentrate gutter 1.010. The spiral trough is located around a central support 1.011. The support 1.011 is used only to support the spiral concentrator. It could, if desired be used to receive and transport concentrate streams, or wash water streams. While not commonly performed, the pipe may be used to supply slurry to the top or inlet of the spiral concentrator, or to recycle a portion of the discharged slurry to the concentrator inlet. Alternatively, the most preferred use of the pipe 1.011 is to receive concentrate from the gutter 1.010. The pipe can include an inner pipe and an outer pipe, one of the pipes being used to collect the slurry concentrate.

In operation, the differences in density, between particles of different mineral species, cause them to separate in the slurry as they flow down the trough. The slurry at the inner portion of the trough experiences a steeper angle of descent than the slurry at the outer rim of the trough because both descend the same vertical distance per revolution, but the horizontal distance travelled at the outer rim is greater than at the inner portion of the trough. The concentrate runs off or is diverted into the concentrate gutter at points part way down the trough or, at the bottom end of the trough, the concentrate runs into, or is diverted into the concentrate discharge channel within what is commonly called the product box.

Multiple spiral troughs can be wound in parallel around a common axis to increase the throughput.

In the remaining figures, the attachment flange, 1.015 in FIG. 1, has been omitted from the drawings to better illustrate other features of the invention.

An adjustable diverter 1.060 is attached to the trough. The diverter includes a diverter member 1.065 which can be adjusted between a position above the slurry flow to a position contacting the bottom of the trough to divert or split the slurry flow. The diverter can have any suitable cross-section. A rectangular cross-section is a suitable shape. The diverter will be described in more detail below.

Figure 2:
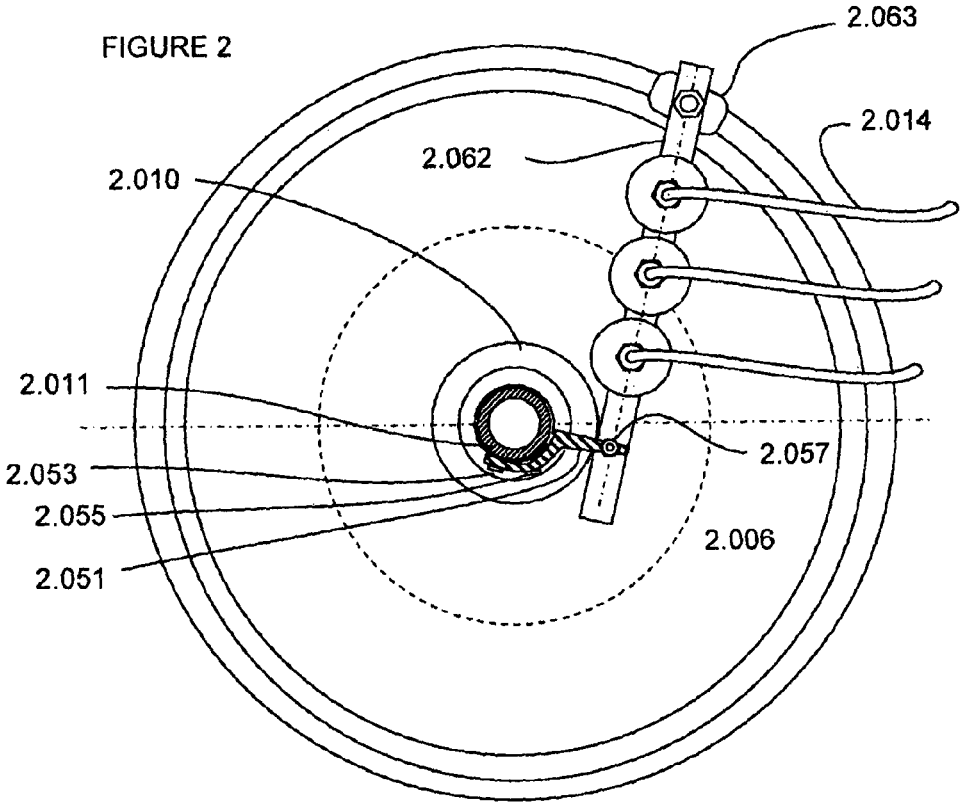
FIG. 2 is a schematic illustration of a partial top view of the arrangement of FIG. 1.

FIG. 2 is a partial top view of the diverter arrangement showing the diverter arm or support 2.062 and a number of pneumatic or hydraulic pressure lines such as 2.014 connecting into the diverter assembly. The pressure lines connect to a controllable pressure source to control an adjustable baffle arrangement as described below.

Attachment means can be provided to attach the diverter to the trough assembly, such as to the central pipe or the trough wall.

The diverter can be attached at one end, eg, to the central pipe 2.011 as shown by way of illustration by the mounting arrangement of an appropriately curved bracket 2.051, self tapping screws 2.053, 2.055, and mounting bolt 2.057, and is braced at the other end, as shown by way of illustration at the attachment 2.063 at the outer rim of the trough. The mounting arrangement shown by way of illustration, includes a curved bracket 2.051 fixed to the pipe 2.011 by means of self drilling and tapping screws 2.053 and 20.055. The arm 2.062 connects to the bracket 2.051 by means of a bolt 2.057. The bolt 2.057 allows relative rotation between the bracket 2.051 and the arm 2.062 during assembly and then by tightening of the bolt they can be secured relative to each other. This arrangement permits selective placement of the diverter arm along the spiral trough. Alternative fixed attachment positions can also be provided.

The arm 2.062 can be inclined in relation to the radial direction, and is adapted to permit the diverter baffle arrangement described below to controllably engage the slurry.

Figure 3:
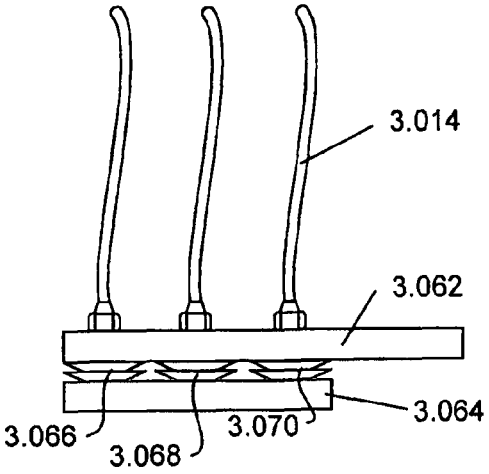
FIGS. 3 to 9 are side illustrations of a diverter according to an embodiment of the invention.

FIG. 3 is a side view of the adjustable diverter 2.060. The diverter arm 3.062 has a number of pressure lines such as 3.014 connected through it to corresponding displacement members 3.066, 3.068, 3.070. Each pressure line 3.014 is associated with a corresponding one of the displacement member 3.066, 3.068, 3.070. While three such displacement members are shown, the number of displacement members can be greater or less than three. A displacement baffle 3.064 is connected to the displacement members. The displacement members can be adapted to be resiliently retracted. In FIG. 3, the displacement members are shown in the retracted state. The displacement baffle can be an elastic, flexible element which can be partly or wholly displaced by the activation (extension) of one or more of the displacement members.

Figure 4:
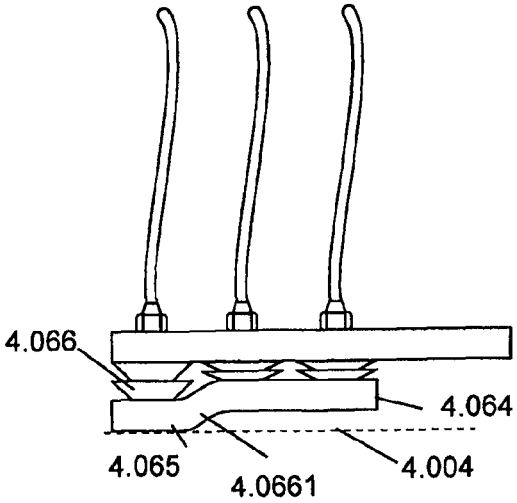

As shown in FIG. 4, the displacement member 4.066 has been extended by the application of pressure via the associated pressure line while the other displacement members remain retracted. The displacement baffle 4.064 thus is flexed so that portion of it, adjacent to the displacement member 4.066, is extended to contact the base 4.004 of the trough. The intermediate portion 4.0661 of the baffle 4.064 is elastically deformed, while the portion connected to the other displacement members remains unextended, leaving the flow of the slurry undisturbed. When the pressure is removed from the displacement member 4.064, it contracts to its unextended state, by an elastic or spring bias in the displacement members, and the baffle relaxes to the state shown in FIG. 3.

Figure 5:
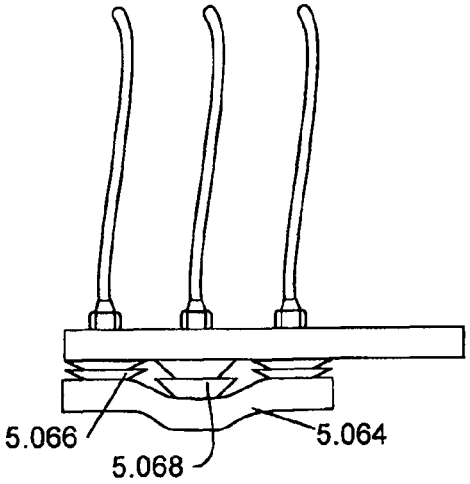

FIG. 5 illustrates the operation of the displacement member 5.068 on its own.

Figure 6:
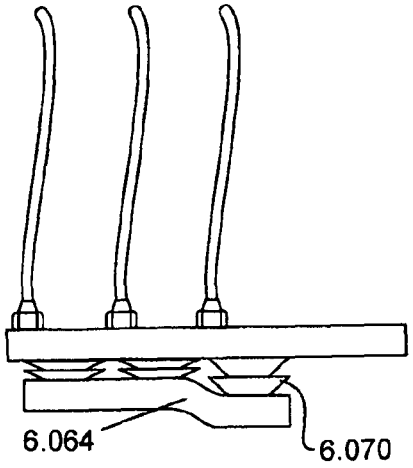

FIG. 6 illustrates the operation of displacement member 6.070 on its own.

Figure 7:
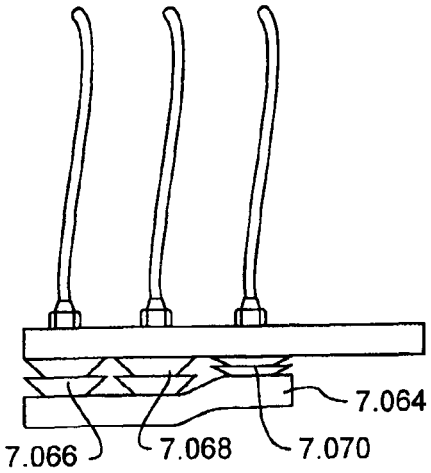

FIG. 7 illustrates the operation of displacement member 7.066 and 7.068 together.

Figure 8:
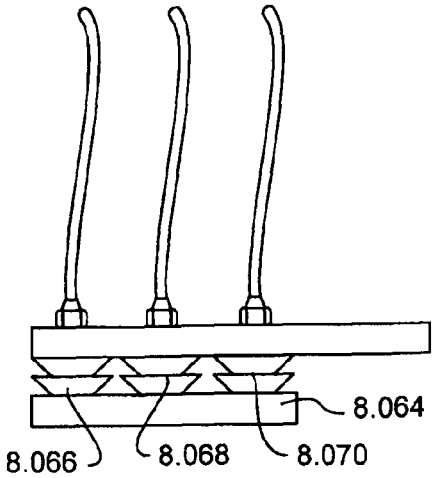

FIG. 8 illustrates the operation of all the displacement members.

Figure 9:
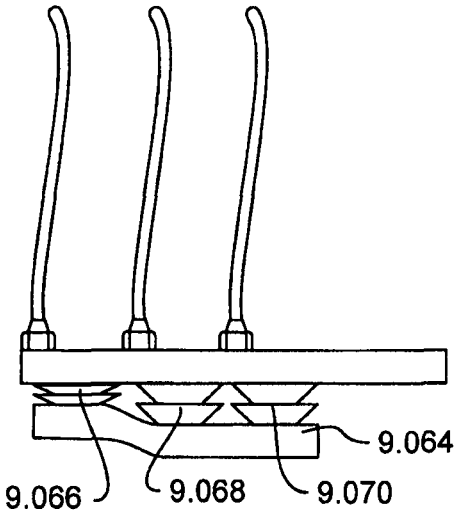

FIG. 9 illustrates the operation of displacement members 9.068, 9.070 together.

The above operational diagrams illustrate the manner in which the baffle member can brought into contact with or removed from contact with the base of the trough so as to at least partially and controllably divert the slurry path.

As shown in FIG. 2, the diverter arm can be aligned to divert at least part of the slurry into the gutter 2.010.

The diverter baffle can be made of any suitable elastically resilient material such as foam rubber, silicone, silicone rubber or soft polyurethane or the like. Preferably the material has high moisture tolerance. Preferably the material is salt resistant. Where individual baffles or deflectors are used, as shown by way of example in FIG. 10 (see below), the diverters do not require the elasticity or flexibility of the other embodiments which deform the unitary baffle or deflector.

The inflatable members can be made of a suitable air impervious, elastic or resilient material. Suitable materials for the inflatable members include, but are not limited to, rubber, polyurethane, silicone rubber, etc. We have found that an operating range of movement of the order of 10 to 20 mm is adequate for successful operation.

The material can be adapted to operate in temperatures from 0° C. to 45° C.

Figure 10:
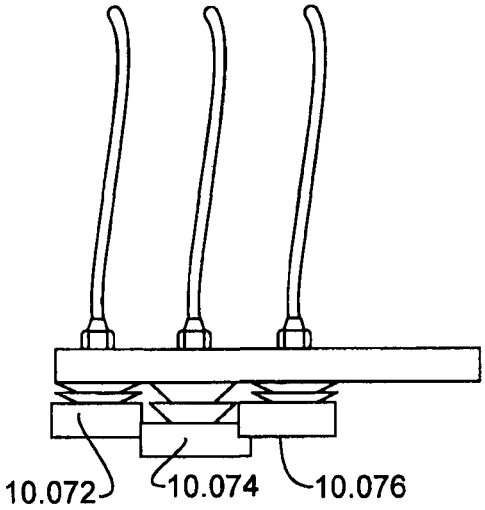
FIG. 10 is a side illustration of a diverter according to another embodiment of the invention.

FIG. 10 illustrates an alternative embodiment of the diverter arrangement, in which each displacement member has an individual displacement baffle 10.072, 10.074, 10.076 so that each baffle can be moved independently. The baffle members can be overlapped or slidingly interlocked or engaged, to present a smoother face to the slurry flow.

In this embodiment, because the baffles are independent, they do not need to be resilient, and can be made from any suitable material.

Figure 11:
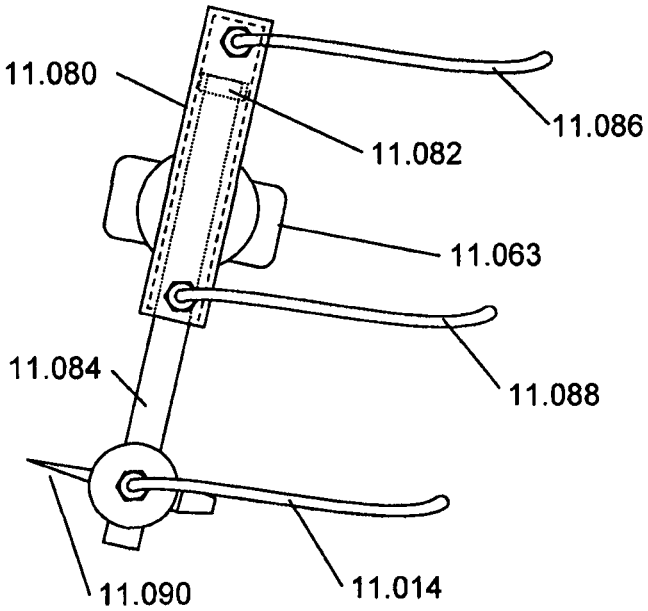
FIG. 11 illustrates a diverter according to a further embodiment of the invention.
Figure 12:
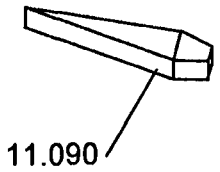
FIG. 12 shows a dart splitter according to an embodiment of the invention.

FIG. 11 illustrates a further embodiment of the invention, in which the displacement baffle is replaced by a dart splitter 11.090. As shown in FIG. 12, a dart splitter can, present the apex of a triangular-shaped member to the slurry flow to precisely divide the concentrate from the tailings.

A further modification of the arrangement of FIG. 11 is that the arm is adjustable to move the position of the splitter inward or outward across the splitter. The arm is adjustable by the use of a piston and cylinder arrangement. The cylinder 11.080 can be attached to the trough by attachment 11.063. The piston 11.082 and piston rod 11.084 can be controlled by the pressure lines 11.086, 11.088 to move the piston within the cylinder.

Alternatively, the arm can be manually adjusted to locate the splitter at the required location.

Figure 13:
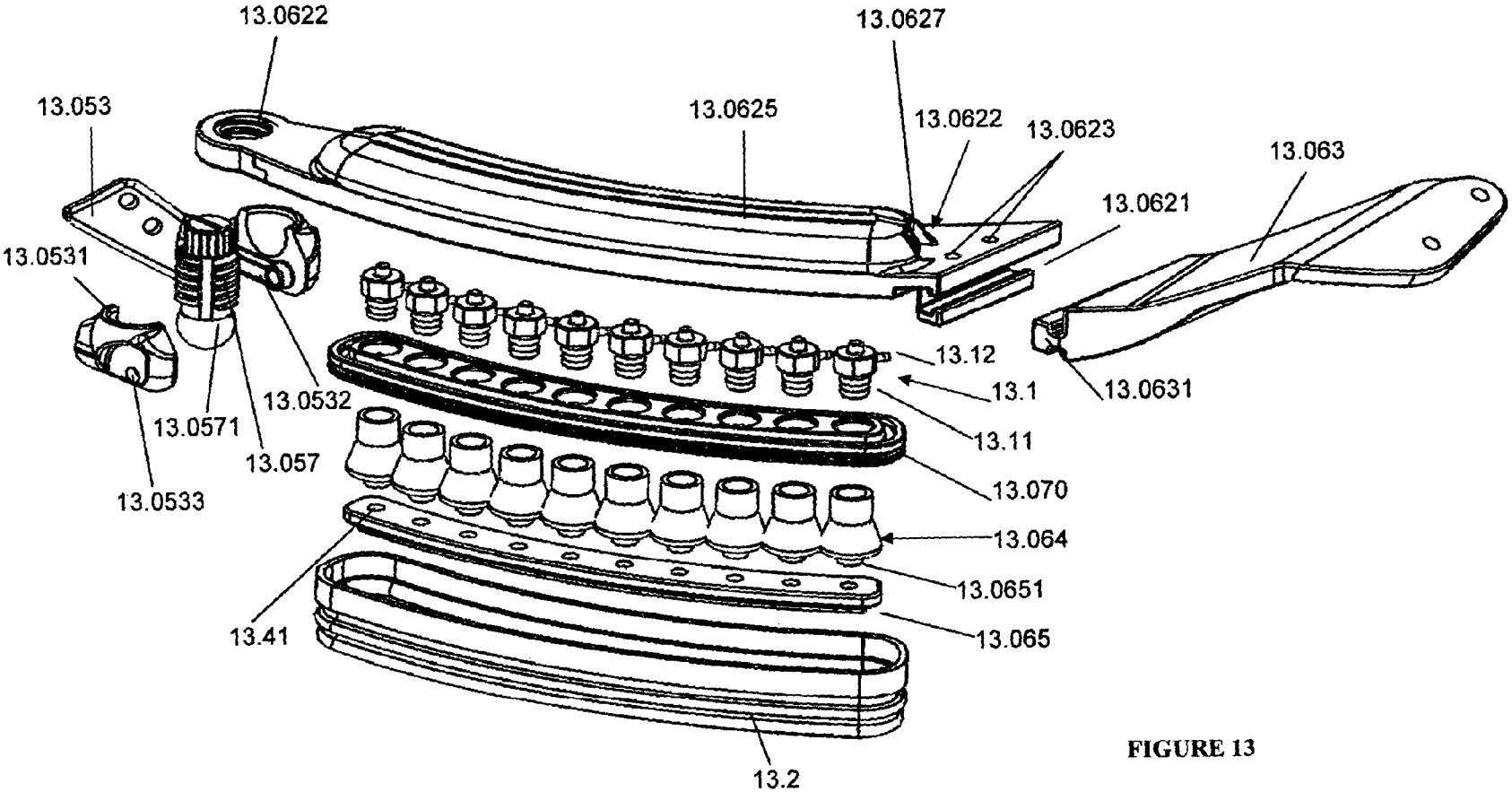
FIG. 13 illustrates an exploded perspective view of another diverter.
Figure 14:
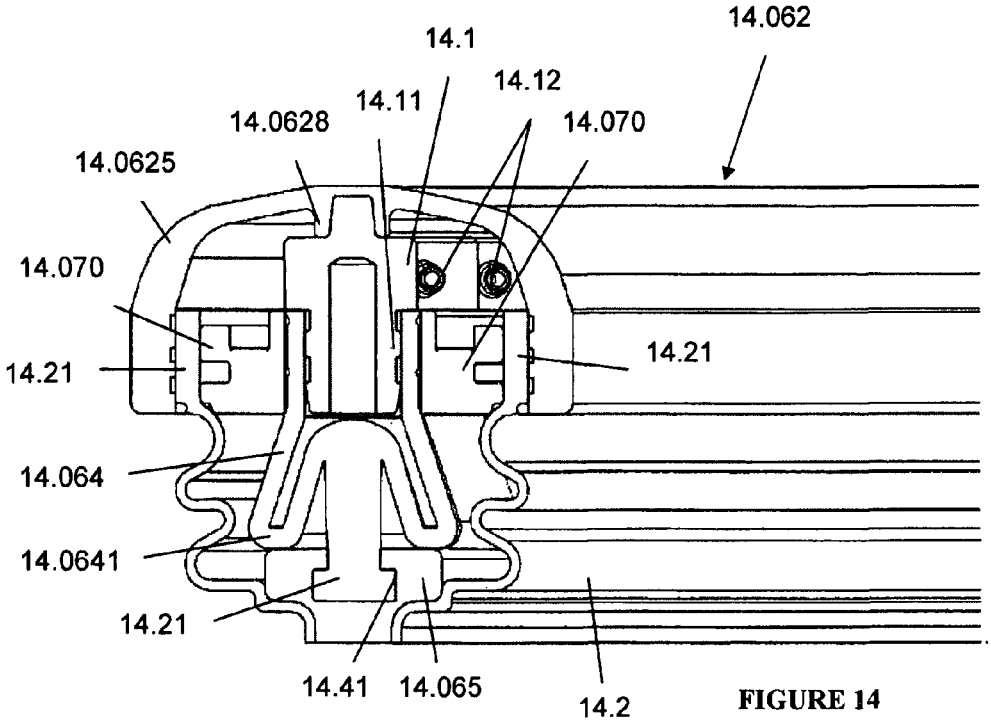
FIG. 14 illustrates a cross-section through the diverter of FIG. 13 when assembled with its shroud in a retracted condition.
Figure 15:
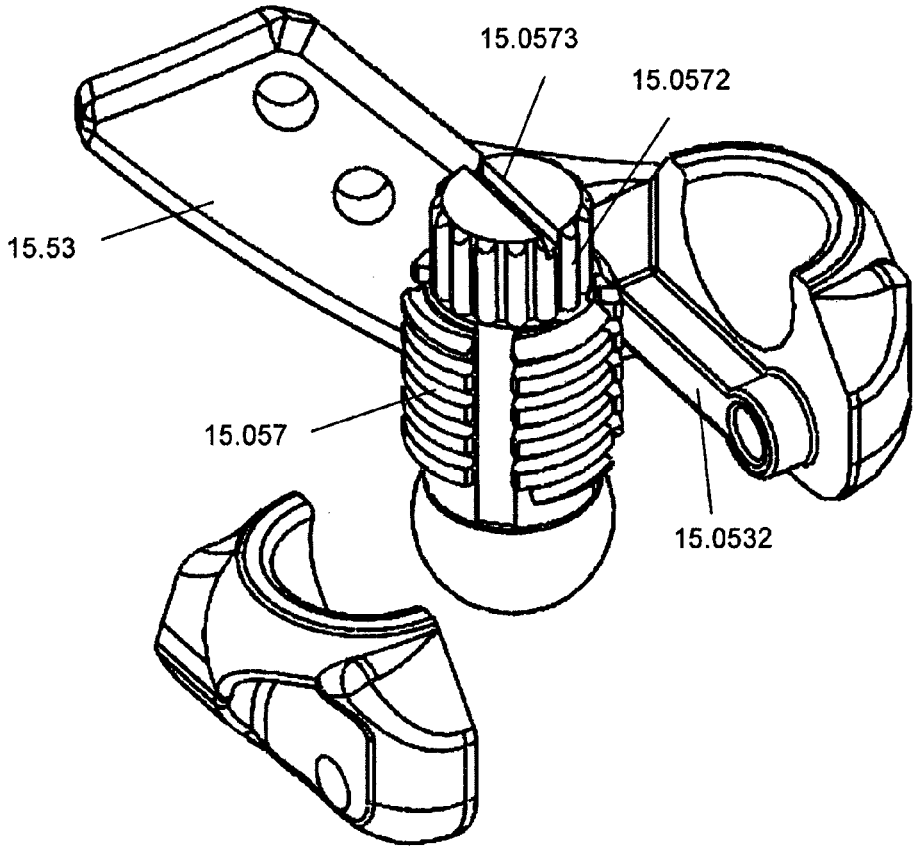
FIG. 15 illustrates an exploded perspective view of a height adjustable ball joint utilised with the apparatus of FIG. 13.

Illustrated in FIGS. 13 to 15 is a relatively rigid diverter arm 13.062, which can be manufactured from any appropriate material such as glass filled nylon, PVC or the like. The arm 13.062 has a dovetail channel formation 13.0621 at one end and a threaded aperture 13.0622 at the other end. The channel 13.0621 receives a mating formation 13.0631 on a mounting bracket 13.063 which is attachable to the rim of a spiral concentrator. The sliding connection between channel 13.0621 and formation 13.0631 enables the ready assembly and disassembly between the two components. In the vicinity of channel 13.0621 are two holes 13.0623 which receive grub screws to secure the arm 13.062 to the bracket 13.063.

The threaded end 13.0622 receives a threaded spigot or ball pin 13.057 on the lower end of which is a ball formation 13.0571. The ball formation 13.0571 is received in a socket formation formed integrally with bracket 13.053 which can be secured to the central column 1.011 of the concentrator. The other half of the socket is formed in a socket cover 13.0531 which is secured and located to the bracket 13.053 by means of a keyhole shaped boss 13.0532 on bracket 13.053 and an aperture 13.0533 in the socket cover 13.0531 through which a threaded bolt, machine screw or such like, can be inserted so as to exert lateral pressure onto the ball 13.0571 by sandwiching it between the socket cover 13.0531 and bracket 13.053.

The arm 13.062 includes a vertically and longitudinally extending actuator housing 13.0625 in which can be located some ten glands or air receiver friction inserts 13.1 which each receive air from pneumatic lines which pass into the arm 13.062 via an opening 13.0627 at the dovetail channel end of the housing 13.0625. The pneumatic lines in turn go to a pneumatic solenoid valve or pneumatic controller system which is not illustrated.

To assemble the diverter, the glands 13.1 are located in a housing array or arm insert 13.070 and are secured thereto and therein by first passing the upper cylindrical rim of nipple bladders 13.064 into a respective aperture 13.0701 and the pushing into the upper cylinder of nipple bladders 13.064 with the union portion 13.11, which thereby forces the outer surface of the bladders 13.064 into a friction fit with the inner circumference of the apertures 13.0701. As is illustrated in FIG. 14, the nipple bladders 14.064 lock onto the unions 14.11 and are kept in this condition by the engagement of the two being held within the housing array 14.2.

Once all the nipple bladders 13.064, ten in total, are in place, then a blind apertured foot 13.4, being manufactured from a rubber or silicone rubber compound which has a series of ten shaped blind recesses 13.41, as best seen in FIG. 14 as feature 14.41, allows the foot or baffle 14.065 to be connected to each of the end formations 14.21 on the nipple bladders 14.064. The shape of the recesses 14.41 and the matching shape of the formation 14.21, that is the provision of mating square shoulders formed by concentric cylinders of different diameters helps to keep the two components together until prosed part for disassembly.

As described with respect to the previous embodiments, the baffle or foot 13.065 is flexible and able to function as is described with respect to FIGS. 5 through to 9 of the previous embodiment. Each of the bladder nipples 13.064 is able to be controlled independently according to the requirements and needs of the spiral concentrator and the operators thereof, by means of remote pneumatic or hydraulic control via the lines that lead to the glands 13.1.

An elastic shroud 13.2 is then assembled around the foot or baffle 13.065 whereby the upper portions of the shroud 14.2 are joined to the housing at 14.21. This is done by means of the arm insert 13.070 being relatively rigid, and dimensioned on its outer periphery to fit into the inner rim of the actuator housing 13.0625 so that that the flexible and or elastic nature of the upper rim 14.21 of the shroud 14.2 will be elastically sandwiched between the inner rim of housing 14.0625 and the outer periphery of the insert 14.070.

As the sub-assembly of the shroud, foot, nipple bladders, arm insert and glands is pushed into the underside of the housing 14.0625, the upper spigots on the glands 14.1 engage an internally formed longitudinally extending channel 14.0628 which receives the upper spigots with an interference fit. This keeps the glands located against the housing 14.0625 and provides a location against which the nipple bladders will expand from to activate the diverter.

Once in the housing 14.0625, there is sufficient room or space between the outer periphery of the glands 14.1 and the upper inner wall of the housing 14.0625, to allow pneumatic tubes to pass there along for connecting the gland passages 14.12 to be connected to an appropriate pneumatic or hydraulic controller.

The side walls of the shroud 14.2 have a bellows formation allowing the shroud 14.2 to expand downwardly when the glands 14.1 receive air pressure which causes the nipple bladders 14.064 to expand. The nipple bladders 14.064 are formed, as best seen in cross section in FIG. 14, with a single, folded upon itself through 180 degrees, angular bellows formation 14.0641 such that the elastic material from which is made, such as silicone rubber, has a shape memory whereby when air pressure is removed, such as by venting the pneumatic line at a remote location, the single bellows formation 14.0641 will cause the lower end of the boot to retract to its upper or retracted position or condition.

The nipple bladders 13.064 and the shroud 13.2, being components of the diverter manufactured from silicone rubber or material of like properties which are relatively elastic and generally soft in nature, allows for their assembly into the inserts 14.070 and arm 14.062, which are relatively rigid, to be done without the need of sealants and or adhesives. Notwithstanding this as the preferred method of assembly, it will be readily understood that silicone sealants and or other types of adhesives and sealants could be used so as to achieve a more permanent assembly.

When making the final assembly to the spiral concentrator, the vertically and rotatably adjustable ball join, as is illustrated in FIG. 15, can be utilised. Once the knuckle or socket has been assembled around the ball 13.0571 and the bracket 13.053 secured to the spiral concentrator central column, and the threaded section of ball pin 13.057 threadingly inserted into the threaded aperture 13.0622, then by rotating the handle 15.0572 or via the screwdriver slot 15.0573, the height of the central column end of the support arm 13.062 can be adjusted. It may be desirous to adjust the height to ensure that the shroud 13.2 will contact sufficient extent of the surface of the concentrator to ensure that the baffle works to an appropriate extent.

Figure 16:
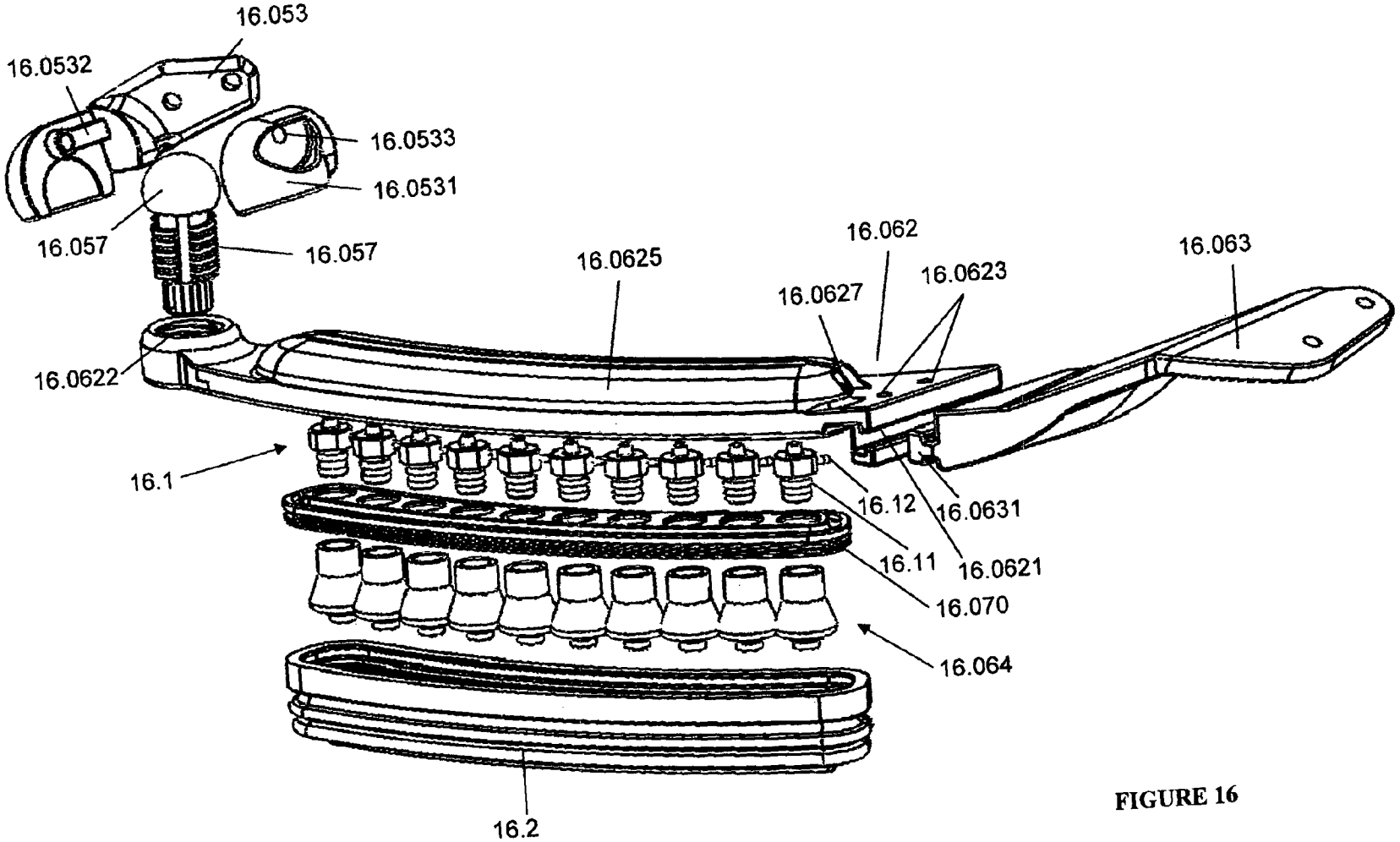
FIG. 16 illustrates a further diverter.
Figure 17:
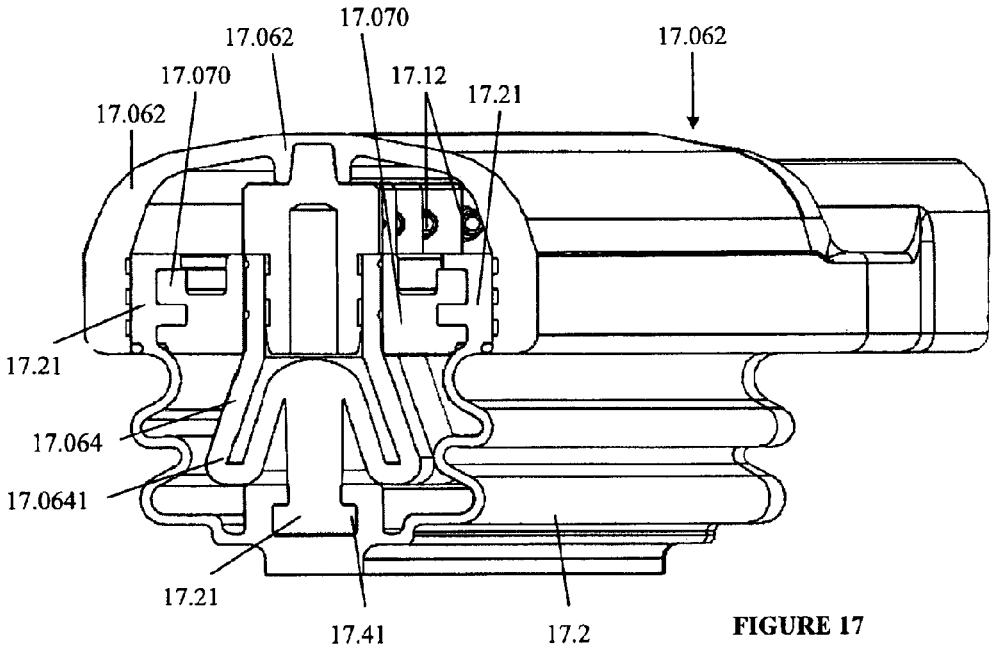
FIG. 17 illustrates a cross-section through the diverter of FIG. 16 in an assembled condition with its shroud in a retracted condition.
Figure 18:
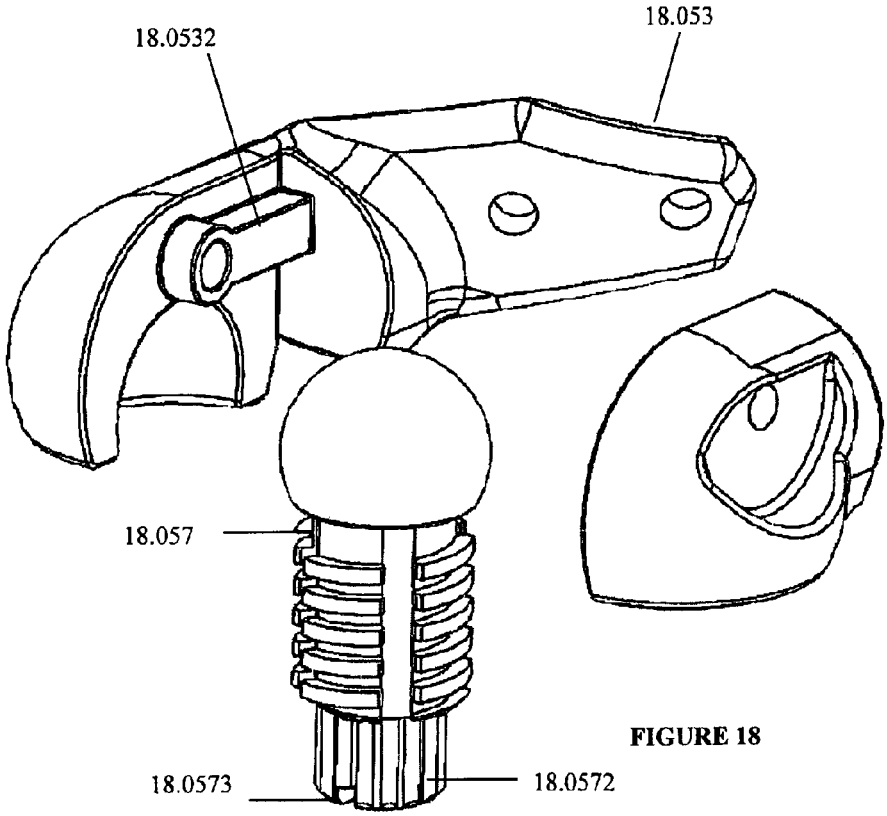
FIG. 18 illustrates an exploded perspective view of a height adjustable ball joint utilised with the diverter of FIG. 16.

Illustrated in FIGS. 16 through to 18 is a similar arrangement to that of FIGS. 13 to 15, with the main difference being that the shroud and baffle as best illustrated in FIG. 17 are combined into a unitary structure. This assists in providing one less assembly step.

The brackets 13.053 and 16.053 are of different shapes. The difference in shape is provided to enable a lower profile bracket to be used in situations where a low level of space is provided which is the case where for example a triple start spiral is present in a concentrator column. In a single or double spiral greater space is present and so bracket 13.053 may be better suited.

If desired, depending upon the complexity of the mould and the selection of materials, the bladders nipples 13.064, the foot 13.065 and the shroud 13.2 can all be formed in a single integral moulding, so as to decrease even further the assembly steps and complexity of the diverter.

Figure 19:
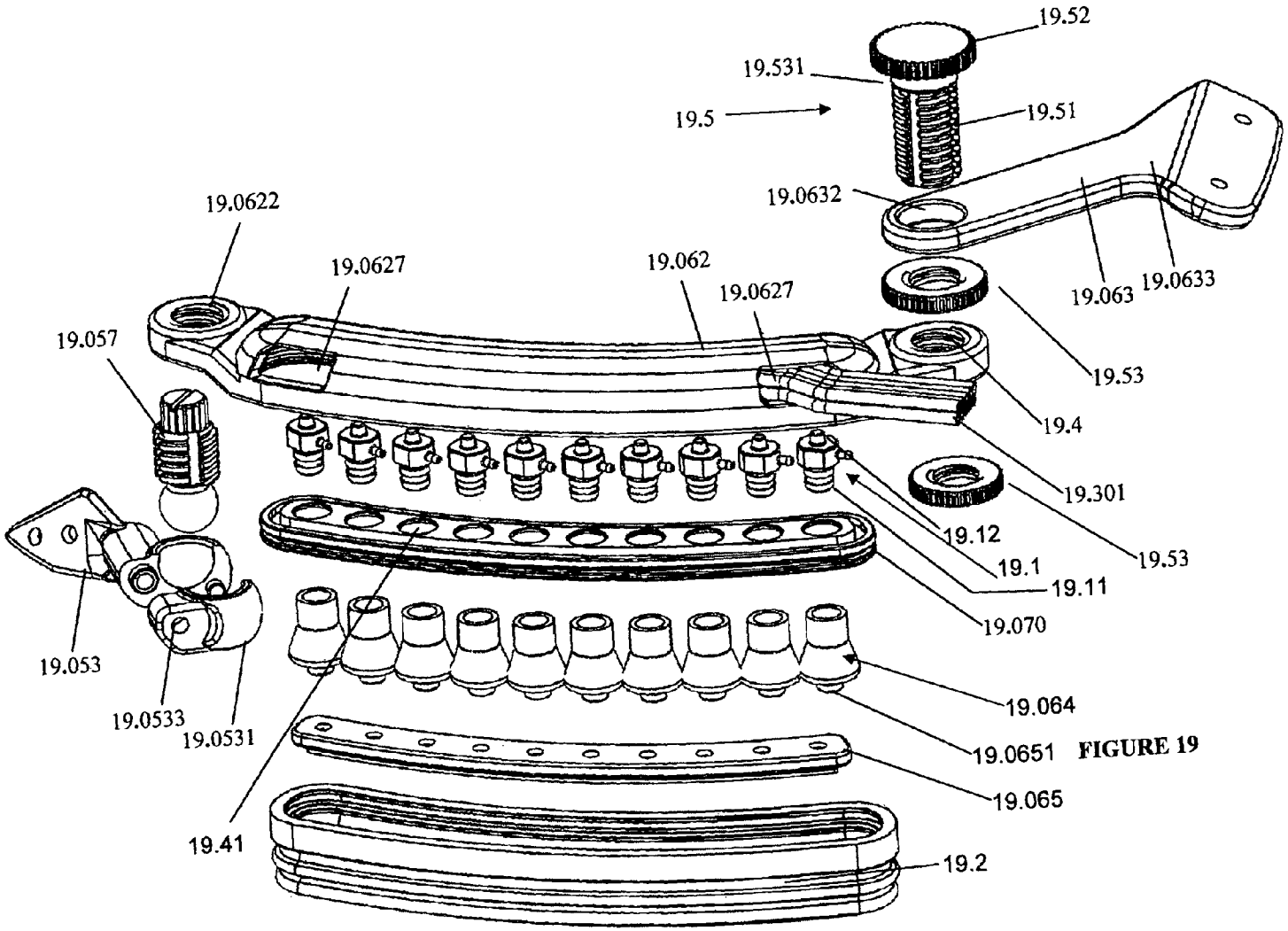
FIG. 19 illustrates an exploded perspective view of another diverter having height adjustable formations at either end of the longitudinal arm.

Illustrated in FIG. 19 is a diverter similar to that illustrated in FIGS. 13 to 18. A difference between the embodiment of FIG. 19 and that of FIGS. 13 to 18 is that the outer diameter fixing of the diverter to the spiral concentrator rim includes a vertical or height adjustment mechanism. This height adjustment mechanism is a threaded aperture 19.4 formed in the end to the arm 19.062 into which can be received a threaded shank 19.51 on a threaded mounting pin 19.5. The pin 19.5 has an upper integrally formed cylindrical head 19.52 which has a knurled periphery to enable gripping by an operator to perform a height adjustment. The pin 19.5 has a smooth cylindrical section 19.531 which will sit in and allow rotation of the pin 19.5 relative to the smooth hole 19.0632 on bracket 19.063. The pin includes a tapered section 20.532 where there is a step change in diameter transitioning to the threaded section. A nut 19.53 having a knurled outer periphery, winds up and stops firmly against the tapered section 20.532, trapping the pin 19.5 in the hole 19.0632.

Figure 20:
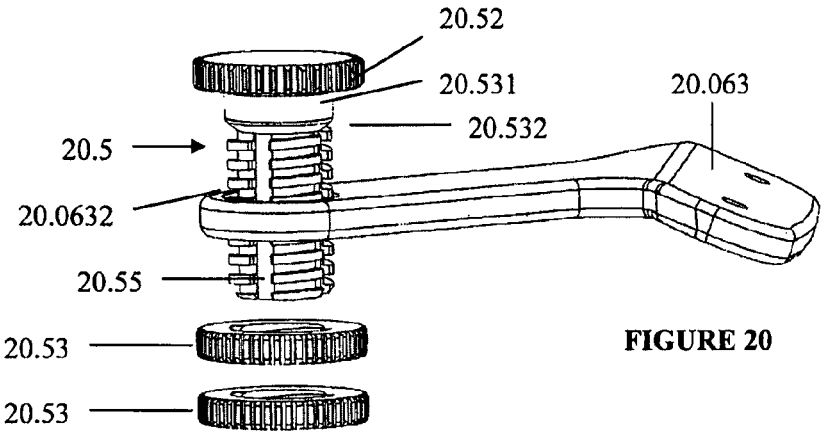
FIG. 20 illustrates a perspective view of a height adjustable mounting bracket.

As illustrated in more detail in FIG. 20, with the pin 20.5 thus captured in the hole 20.0632 and the height or thickness of the section 20.531 will be able to spin freely therein. This will leave the threaded shank 20.51 hanging downwardly from the bracket 20.063 whereby the threaded aperture 19.4 can readily engage the end of the shank 20.51. Once engaged by the threads, the side of the arm 19.062 with the aperture 19.4 can be readily height adjusted relative to the position of the bracket 20.063. Once the desired height has been achieved, the arm 19.062 can be locked relative to the pin 19.5 by means of a second nut 19.53 which will perform the function of a lock nut. Depending on the ultimate height adjustment, the locking nut 19.53 can be located above the threaded aperture 19.4 or under the threaded aperture 19.4 and perform a similar function.

The bracket 19.063 has an outer portion 19.0633 which is shaped for ready engagement with the periphery of the spiral concentrator. The shape is shown as being angled with respect to the concentrator rim, and the bracket extends at an angle to the tangent of the rim. The desired shape of the bracket 19.063 is such that it is designed to engage a clockwise downward spiral concentrator. To engage a counter clockwise downward spiral concentrator will either require a mirror image bracket to be provided, or the bracket can be of a flat T-shape or similar to allow the bracket to engage a counter clockwise downward spiral concentrator but will also allow the bracket 19.063 to be flipped through 180 degrees, whereby the now underside of the bracket 19.063 would be able to engage the rim of a counter clockwise concentrator.

The features of FIG. 19 in addition to the height adjustability of the joining system of FIGS. 13 and 16, enable a single diverter arm and housing to be manufactured which will suit both clockwise and counter clockwise downward spiral concentrators.

The pins 19.057. 13.057, 16.057 are illustrated with a thread having a longitudinal channels transverse to the thread. These channels enable the thread to be moulded in an injection moulding die and to allow the pin to be extracted from the die.

It will be noted that on the arm 19.062 there are two apertures 19.0627 to allow the arm to be used on clockwise and or counter-clockwise spiral concentrators, that is the arm 19.062 can be reversed as needed. Preferably the arm 19.062 is moulded of a rigid polymeric material, as is the insert 19.070. The apertures 19.0627 can each be made with a closure covering the aperture and a line of weakness around the periphery of the closure so that the appropriate closure can be pushed out depending on which type of spiral it is to be used with. As visible in FIG. 19, the pneumatic conduits 19.301 exit the arm 19.062 from the right hand side aperture 19.0627 and head off to the controller as described below.

It will be noted that the bracket 19.053 has two cylindrical spigots on its joining face to mate with two cylindrical recess on the socket cover 19.0531, so as to prevent the cover 19.0531 rotating relative to bracket 19.053, as well as to ensure correct alignment of the socket portions to receive the ball of pin 19.057. These cylindrical spigots and recesses replace the key hole shaped spigots and recesses of earlier figures.

Figure 26:
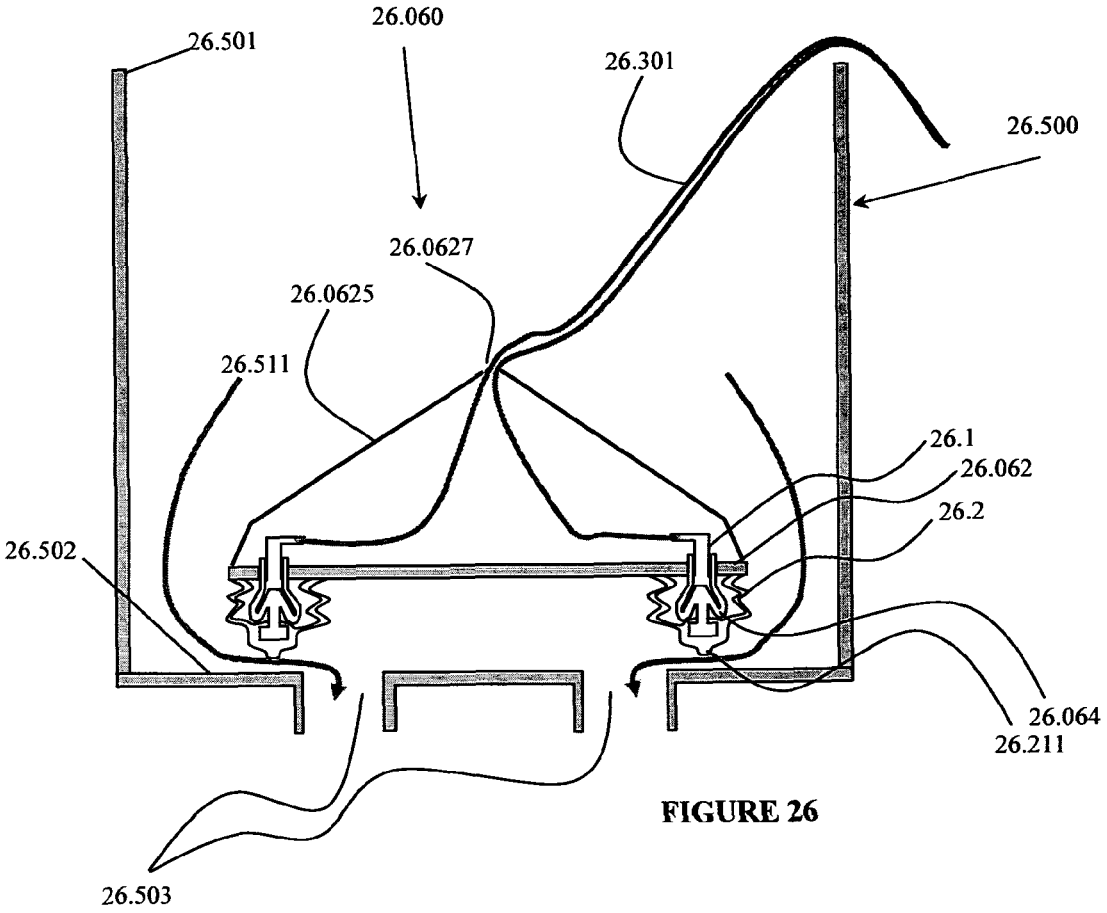
FIG. 26 illustrates schematic cross section of a diverter or flow controller, such as that illustrated previously, wherein the diverter or flow controller is wholly immersed in the apparatus which requires a flow controlled, which in this case is an up-current classifier.
Figure 27:
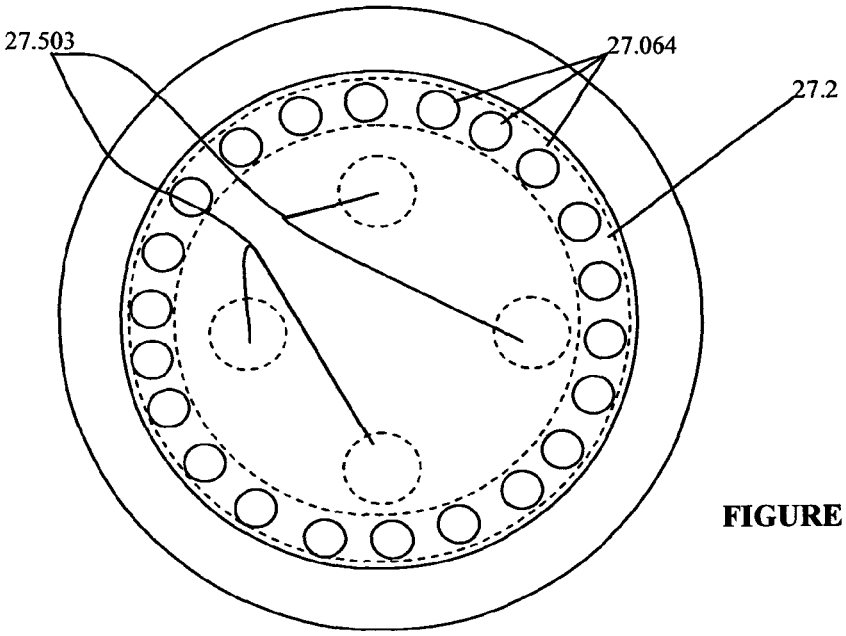
FIG. 27 illustrates a schematic plan view of the apparatus of FIG. 26.

In the embodiment of FIG. 1, the diverter or flow controller is arranged so as to be in a straight line, while the diverter or flow controller of FIGS. 13, 16 and 19 are curved. The selection of straight, curved convex with respect to the flow or curved concave with respect to the flow, can be selected so as to achieve any desired result depending upon the flow conditions, or the mineral being processed or the shape of the mineral processing apparatus. For example the diverter of flow controller of FIGS. 26 and 27 is annular or circular in shape as will b described in detail below.

The embodiments described above enable remote manipulation of the shape of the diverter member and hence the ability to influence the operation of the concentrator remotely. Two or more such diverters can be operated simultaneously as will be described below.

Figure 21:
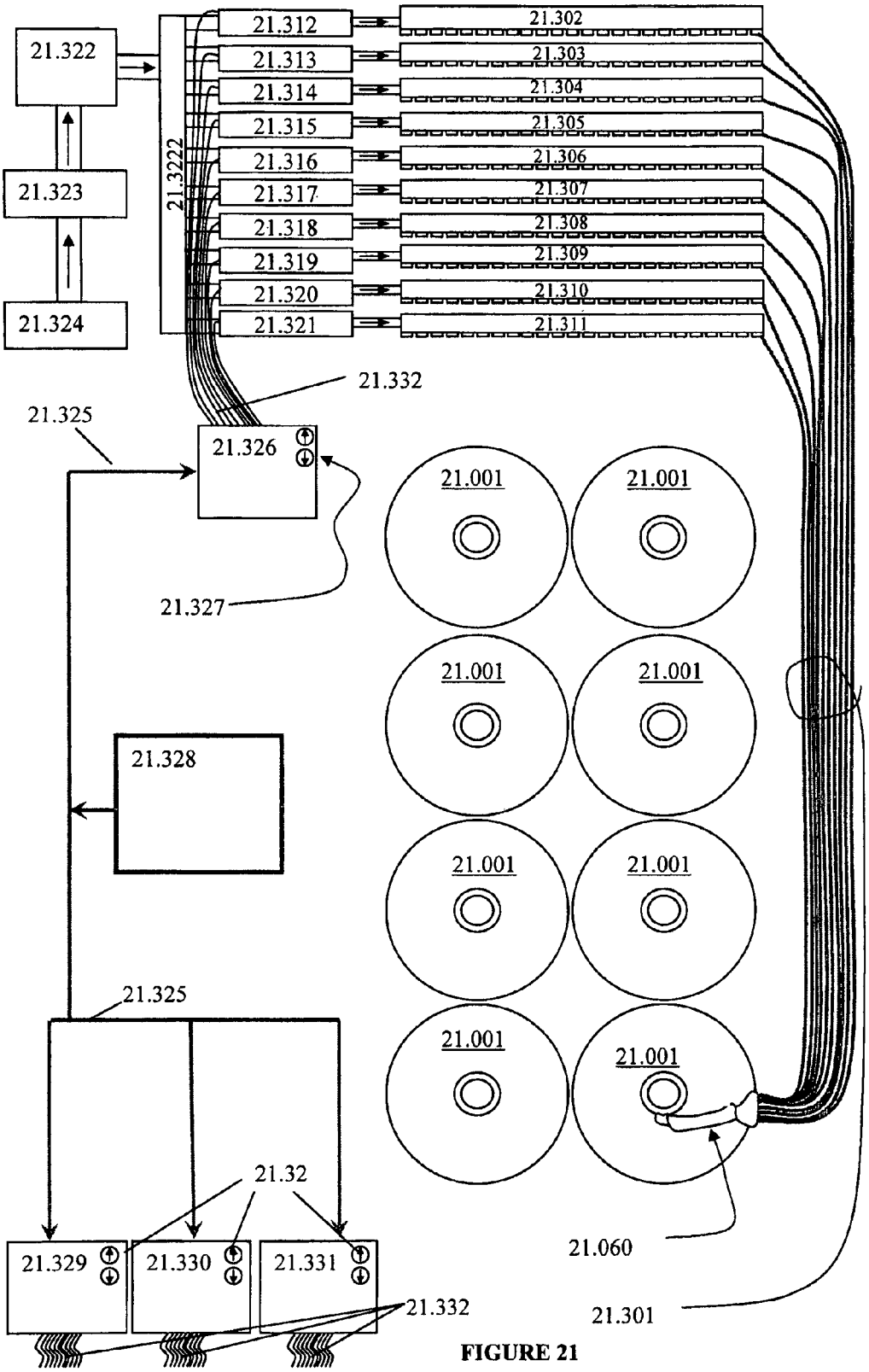
FIG. 21 illustrates a schematic view of the diverter of previous figures and the control system for its control.

In FIG. 21 is a schematic of a control system for use with a plurality of diverters 21.060 as discussed above for illustrative purposes with respect to FIG. 13. The control system is used with a bank of 8 triple start spirals, making a total of 24 troughs. The 10 nipple bladders 13.1 of each one of the 24 diverters 21.060 applied to respective spirals are connected by pneumatic or airline conduits 21.301 so that each of the outer nipple bladders 13.1 (that is closest to the outer rim of the spiral) all connect to the 24 way manifold 21.302 which receives compressed air from solenoid valve 21.312. The next adjacent inwardly located nipple bladder 13.1 of each of the 24 diverters, will all be connected by pneumatic tubing to the 24 way manifold 21.303 which is controlled by solenoid valve 21.313 and so on until the same position nipple bladder on each of the 24 diverters connect up to the respective 24 way manifolds 21.304 to 21.311, which are respectively controlled by solenoid valves 21.314 to 21.321.

The solenoid valves 21.312 to 21.321 each receive compressed air from a 10 way master manifold 21.3222 which in its turn receives compressed air from a mains air supply or compressor 21.324, via an accumulator 21.323 and a pressure regulator 21.322.

The preferred method of operation of nipple bladders 13.1 is that when air pressure is delivered to the nipple bladder then the nipple bladder extends downwardly, and when air pressure is removed then the nipple bladder 13.1 will retract. Accordingly, if for the settings of the diverter the nipple bladders 13.1 need to be extended, then all, or a combination of one or more of the solenoids 21.312 to 21.321 will be activated to allow compressed air to expand respective nipple bladders.

Each of the solenoids 21.312 to 21.321 receive, via cables 21.332, current from a PLC (programmable logic controller) controller bank 21.326 so as to open or close the solenoids, depending upon the required operation of each spiral. The PLC controller bank 21.326 receives signals 21.325 from the control room 21.328 in order to control the output from the first bank of 8×3 spirals. The same control room can be simultaneously or otherwise, sending signals to PLC controller banks 21.329, 21.330 and or 21.331 to control a second, third and fourth banks of 8×3 spirals by electrical wires 21.332 going off to respective solenoids as described above, which are not illustrated. The PLC controller banks 21.326, 21.329, 21.330 and or 21.331 can include local over ride features 21.327, so that the PLC can be overridden if required by the operators.

While the arrangement of FIG. 21 could be generally described as a parallel system where the respective nipple bladders on the diverters are all connected to the same solenoid. If desired each diverter can be made to have all the nipple bladders on it connected to one 24 way manifold and thus one solenoid valve, so that activation of the one solenoid valve makes all the nipple bladders operate at the same time. While this is not preferred in some circumstances it may be appropriate in other circumstances.

In order to keep pneumatic lines in FIG. 21 in an organised arrangements, pneumatic lines or air tubes 21.301 which all share the same origin and destination can be bundled together by being welded or bonded together along their edges in ribbons or clusters, or possibly encased in a conduit. Further, colour coding can be utilised to distinguish tubes or airlines that respectively pertain to a nipple bladder's relative position from 1 to 10. It is noted that the number of nipple bladders could be less than or greater than 10 in other embodiments of this invention.

By the control system above multiple mineral processing apparatus are arranged or organised into banks or clusters, whether located close to each other or not, and can be made to simultaneously or sequentially, in parallel or in sequence, or in a pre-programmed pattern have their respective displacement members functioning to achieve the same desired result from the respective one of the multiple apparatuses.

Figure 22:
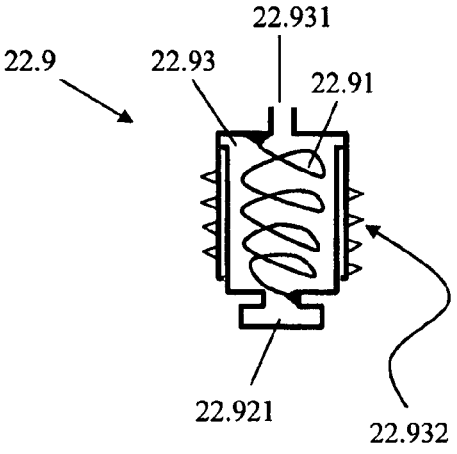
FIG. 22 illustrates a schematic of a linear actuator being air activated and spring return in a retracted condition.
Figure 23:
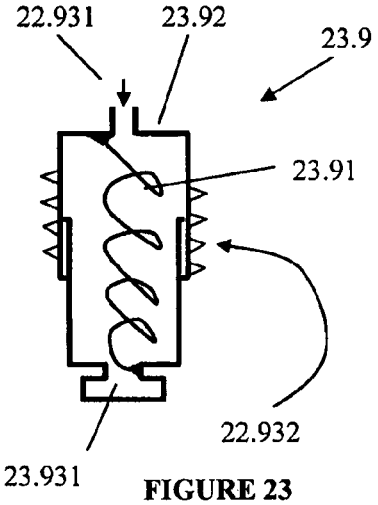
FIG. 23 illustrates a schematic of a linear actuator of FIG. 22 in an extended condition.

Illustrated in FIGS. 22 and 23 is a combination air and return spring piston and cylinder arrangement or linear actuator 22.9 arrangement which can be used as a replacement of the nipple bladders 13.1 or similar. The actuator 22.9 includes a cylinder 22.93 which has a threaded outer circumference 22.932 so that the cylinder 22.93 can be received in the apertures in insert 13.070 which will have like threads for securing them together. The upper end of the cylinder 22.93 includes an air entry port 22.931. The actuator 22.9 also has a piston 22.92 which is slidingly sealed relative to the inner diameter of the cylinder 22.03 for sealed relative movement between the two. The underside end of the piston 22.92 includes a cylindrical formation 22.921 similar in shape to formation 13.0651 to be received by aperture 13.41 in the foot 13.065. In the non pressurised state of FIG. 22, the linear actuator is retracted and biased so by a tension spring 22.91, whereas the piston portion 22.92 extends away from the cylinder portion 22.93, against the bias of the spring 23.91 when compressed air enters the port 22.931. The compressed air can be delivered to the linear actuator 22.9 by a system as described above.

Figure 24:
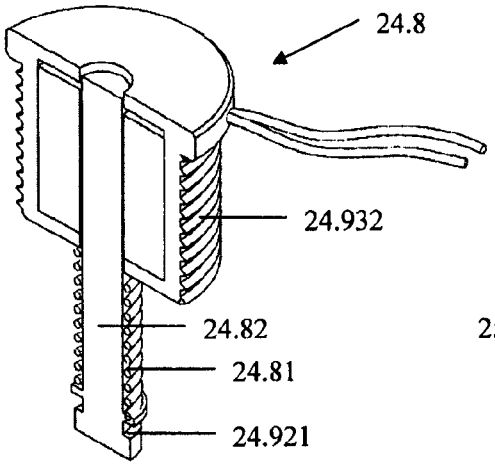
FIG. 24 illustrates a perspective cross section through a solenoid with push rod in an extended condition, which can be used to activate the diverter of earlier figures.
Figure 25:
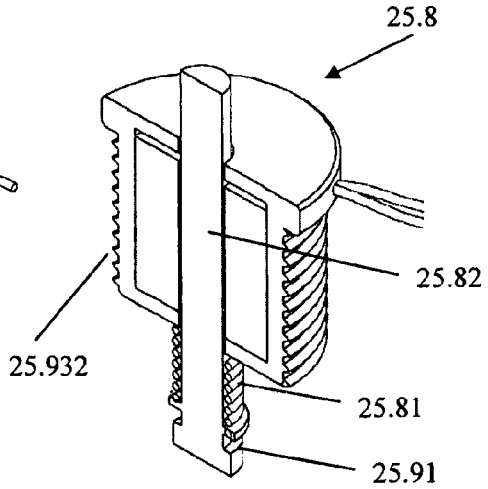
FIG. 25 illustrates a perspective cross section through the solenoid of FIG. 24 showing the push rod in a retracted condition.

As an alternative to the nipple bladders 13.1 and or the linear actuators 22.9, a miniature solenoid as illustrated in FIGS. 24 and 25 could be utilised. In the cross sections of FIGS. 24 and 25, a tension spring 24.81 keeps the push rod 25.82 in the retracted condition of FIG. 25, so that when the coil is energized the push rod 24.81 extends against the bias of the spring 24.81, in order to extend the diverter towards the trough of a spiral. The end of the push rod 24.81 includes a cylindrical formation 24.921 similar in shape to formation 13.0651 to be received by aperture 13.41 in the foot 13.065.

While the above systems work on the basis that application of compressed air or energizing of solenoid extends the diverter to engage the trough of s spiral, embodiments can be built whereby the application of pressure or the application of current retracts the diverter away from the spiral.

In the case of using solenoids as actuators, application of current can cause extension of the displacement member and reversal of the current can cause positive retraction of the displacement member as an alternative to relying on a retraction spring or elastic member.

Illustrated in FIGS. 26 and 27 is an up current classifier 500 (which can sometimes be called a hydraulic classifier or a teeter bed style classifier), which separates lighter particulates by capturing them in an up current of water or wash liquid, and lighter particulate flows over the upper rim 26.501 with wash liquid which also exits the classifier 26.500 from the upper rim 26.501. At the base 26.502 of the classifier, the heavier particulates will gather as they have sunk to the lowest level of the classifier 26.500. The heavier particulates will flow out with the slurry they are in, via outlet or drainage apertures 26.503. In this embodiment, the slurry having the heavy particulate is dammed or blocked from passing out to the drainage apertures 26.503 by an annular shroud 26.2, which is best seen in FIG. 27. The shroud 26.2 extends downwardly away from a circular support plate 26.062, 27.062 which ha a conical shield or housing 26.0625 which has control leads or conduits 26.301 passing out of it through an aperture 26.0627. This aperture can be sealed so as to prevent slurry from entering the inside of the housing 26.0625.

The conical sides of the housing 26.0625 have a cone angle which enables slurry and heavy particulates which fall thereon to make their way to the very base of the classifier 26.500, ultimately to exit therefrom. The cone angle would be selected to match the particulate and its flow characteristics. Like previous embodiments the support plate 26.062 receives the upper rims of nipple bladders 26.064, in this case some 22 of them, and these are secured therein by engagement of glands or air receiver friction inserts 26.1, which receive their compressed air from the conduits 26.301, of which only two are illustrated for clarity purposes.

The shroud 26.2 is preferably of the sort as described above with respect to FIG. 16, wherein the shroud and foot are formed as an integral moulding and can be formed in a single moulding, that is in one annular formation, or can be moulded in segments for connection to one or a multiple number of displacement members, mounted to the support plate 26.062. The base of the shroud 26.2 includes a shaped dam or formation 26.211, so that when the bladders 26.064 are extended, an adequate seal can be formed against the base 26.502, which will prevent the flow of heavy particulate slurry, or just the heavy particulate, into the drain apertures 26.503. When one or more nipple bladders 26.064 are retracted, a space formed between the base 26.502 and the dam 26.211, is sufficient to allow the slurry to flow out through the drainage aperture 26.503, as is generally indicated by arrows 26.511.

By means of a control system such as described with reference to FIG. 21, the diverter or flow controller of FIGS. 26 and 27 can be operated so that for example a single nipple bladder 26.064 is retracted, then on the diagonally opposite side another nipple bladder 27.064 can be retracted after the first one is closed. By retracting the bladders in pattern, and not opening them all at the same time, ensures that there is a build up of heavy particulates near the shroud and its associated bladder, such a build up being richer in heavy particulate than water or wash liquid. This ensures that mainly heavy particulate will pass under the shroud once the respective bladder is retracted. Further depending upon the flow characteristics, a pattern of bladder retraction can be set into the controller in order to attempt to optimise the heavy particulate output through drainage apertures 27.053.

Also, in like manner to the controller system of FIG. 21, multiple classifiers 26.500 can be arranged or organised into banks or clusters, whether located close to each other or not, and can be made to simultaneously or sequentially, in parallel or in sequence, or in a pre-programmed pattern have their respective displacement members functioning to achieve the same desired result from the respective ones of the multiple classifiers.

The support plate 27.2 is secured into the classifier 26.500 by brackets or other mounting structure which assists to keep the support plate 27.2 at a predetermined height relative to the extension required of the shroud 26.2 to form an adequate seal when the bladders are extended.

In this specification, reference to a document, disclosure, or other publication or use is not an admission that the document, disclosure, publication or use forms part of the common general knowledge of the skilled worker in the field of this invention at the priority date of this specification, unless otherwise stated.

In this specification, terms indicating orientation or direction, such as "up", "down", "vertical", "horizontal", "left", "right" "upright", "transverse" etc. are not intended to be absolute terms unless the context requires or indicates otherwise.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A diverter or flow controller for controlling a flow on or within an apparatus, including at least one diverter or flow controller element and a plurality of displacement members adapted to move at least part of said diverter or flow controller element into or out of contact with a flow path, wherein each of said plurality of displacement members comprises an expandible bladder and said expandible bladder is individually inflatable or deflatable, and a plurality of actuators, each of which actuates a different one of said plurality of displacement members.

2. A diverter or flow controller as claimed in claim 1, including attachment means to attach the diverter or flow controller to the apparatus or a trough assembly of the apparatus.

3. A diverter or flow controller as claimed in claim 1, wherein said diverter or flow controller includes mounting means to connect to a mounting bracket, said mounting bracket adapted to be mounted to said apparatus.

4. A diverter or flow controller as claimed in claim 1, wherein said diverter or flow controller includes a housing to cover one or more of said plurality of said displacement members.

5. A diverter or flow controller as claimed in claim 1, wherein said plurality of displacement members move into or out of contact with said flow path by extension or retraction of said displacement members toward or from an inner surface of said trough assembly of the apparatus.

6. The diverter or flow controller as claimed in claim 1, wherein said inflatable bladder is a bellows or bellows formation formed by a portion of a wall being formed at moulding with a wall portion that folds back over itself through approximately 180 degrees.

7. The diverter or flow controller as claimed in claim 1, wherein said wall portion that folds back over itself comprises a bend with elasticity sufficient to provide a retraction basis.

8. The diverter or flow controller as claimed in claim 1, wherein at least a portion of said inflatable bladder comprises a material with at least one property selected from the group consisting of elasticity, shape memory, material memory and rigidity.

* * * * *